United States Patent [19]

Kinghorn, Jr.

[11] Patent Number: 4,811,859

[45] Date of Patent: Mar. 14, 1989

[54] SEAL FOR FLOATING ROOF

[76] Inventor: Mark D. Kinghorn, Jr., 11903 W. 90th Ave., St. John, Ind. 46373

[21] Appl. No.: 125,702

[22] Filed: Nov. 27, 1987

[51] Int. Cl.[4] ..... B65D 88/46

[52] U.S. Cl. ..... 220/224

[58] Field of Search ..... 220/221, 222, 224, 226

[56] References Cited

U.S. PATENT DOCUMENTS

| | | | |
|---|---|---|---|
| 2,108,380 | 2/1938 | Lentschewsky | 220/224 |
| 2,568,728 | 9/1951 | Goldsby et al. | 220/224 |
| 4,099,643 | 7/1978 | Wardwell et al. | 220/226 |
| 4,273,250 | 6/1981 | Kinghorn, Sr. et al. | 220/226 |
| 4,341,323 | 7/1982 | Kerby | 220/224 |
| 4,524,878 | 6/1985 | Imhof | 220/224 |

*Primary Examiner*—Joseph Man-Fu Moy

*Attorney, Agent, or Firm*—Wall and Roehrig

[57] ABSTRACT

A sealing system for a liquid storage tank having a pontoon roof or cover floating on the liquid product contained within the storage tank. A stepped metallic shoe is constructed to maintain contact with the inner wall of the liquid storage tank which, in cooperation with a vapor impermeable fabric skirt, functions as a primary seal. A secondary seal, having an "E"-shaped cross section functions to maintain vapor integrity. The structure of these two seals is especially suitable for, respectively, sealing horizontally and vertically disposed rivet seams.

8 Claims, 1 Drawing Sheet

SEAL FOR FLOATING ROOF

BACKGROUND OF THE INVENTION

This invention relates in general to sealing systems for liquid storage tanks and, in particular, to a sealing system for preserving the integrity of liquid contianed in a liquid storage tank, and limiting the evaporation into the environment of the contents contained therewithin.

More specifically, but without restriction to the particular use which is shown and described for purposes of illustrating a preferred embodiment of the invention, this invention relates to a seal for sealing the annular opening or rim space between a floating roof or cover and the inner wall or shell of a liquid storage tank containing a liquid upon which the roof or cover floats.

Liquid storage tanks for containing large quantities of a stored liquid, such as petroleum products, are generally constructed either by welding or riveting steel sections together to form a liquid-tight cylinder having an open upper end which is closed by a floating roof or cover which floats upon the liquid contained within the storage tank and is appropriately sealed to prevent contamination of the liquid contained within the tank, and the escape of vapors from the tank into the atmosphere. The sealing systems for such tanks are exposed to the elements and must be designed such that the seals will resist wind loading forces applied to the tank which move the floating roof within the confines of the internal wall or shell of the storage tank. Such seals not only must exert a sufficient countering force against the inner wall of the tank to maintain seal integrity on both the upwind and downwind side, but must accommodate the eccentricity of the tank walls, which frequently results in the floating roof and the inner wall or shell of the tank being non-concentric.

One attempt to provide a suitable seal for the rim space between the floating roof or cover and the inner wall of the tank shell has been the use of a shoe-type sealing system which seals the rim space annulus between the floating pontoon and the inner walls of the tank. Shoe-type sealing systems utilize a hanger-pusher assembly to hold the floating pontoon away from the inner wall of the tank, while applying a centering pressure against the tank shell. To his end, a shoe plate forms a horizontal ring about the pontoon, between the pontoon and the inner wall of the tank shell. The shoe plate slides up and down the inner wall of the tank shell as the pontoon rises and falls with variations in the quantity of the liquid stored within the storage container. A curtain or fabric seal extends from the shoe to the floating roof or pontoon to close the annular rim space.

While such shoe-type seals are suitable for certain types of applications, such seals may not be flexible enough to compensate for tank shell irregularities and, therefore, are frequently incapable of maintaining the vapor seal integrity and the permissible maximum gap requirements set forth by state and federal codes and regulations. As a result of this inability to compensate for tank shell irregularities, such sealing systems may discharge excessive vapor into the atmosphere.

Resolving the problem of tank shell irregularities is even more difficult when providing a seal for a liquid storage tank which is fabricated by riveting sections of steel plate together. In such applications not only is tank eccentricity encountered, but the vertically and horizontally disposed rivets used in fabricating the tank produce irregularities in the inner wall of the tank shell which are encountered by the sealing system as the floating roof moves vertically within the tank sheel in response to variations in the quantity contained within the storage tank. One such attempt to construct a seal especially suitable for use with a storage tank of riveted construction is disclosed in the inventor's prior patent, U.S. Pat. No. 4,273,250 "SEALING SYSTEM FOR LIQUID STORAGE TANKS". In this patent, the inventor has disclosed a sealing system utilizing a seal having an "E"-shaped cross section with a plurality of outwardly extending flanges positioned adjacent to shorter flanges which function as a stiffening or brace to prevent the longer sealing flanges from bending down into contact with each other, or too far so that they might lose their sealing function. The present invention is an improvement of the inventor's prior sealing system.

SUMMARY OF THE INVENTION

It is, therefore, an object of this invention to improve sealing systems for liquid storage tanks of the type wherein a floating roof or cover floats on the liquid contained within the storage tank.

Another object of this invention is to improve liquid storage tank sealing systems of the type using a shoe-type seal to permit greater flexibility of use, and maintain vapor-sealing integrity when encountering irregularities in the inner wall of the tank shell.

A further object of this invention is to provide an improved shoe-type sealing system which is especially useful with liquid storage tanks fabricated by a rivet construction.

These and other objects are attained in accordance with the present invention wherein there is provided a sealing system for a liquid storage tank having a pontoon roof or cover floating on the liquid product contained within the storage tank. A stepped metallic shoe is constructed to maintain contact with the inner wall of the liquid storage tank which, in cooperation with a vapor impermeable fabric skirt, functions as a primary seal. A secondary seal, having an "E"-shaped cross section functions to maintain vapor integrity. The structure of these two seals is especially suitable for, respectively, sealing horizontally and vertically disposed rivet seams.

DESCRIPTION OF THE DRAWINGS

Further objects of the invention, together with additional features contributing thereto and advantages accruing therefrom, will be apparent from the following description of preferred embodiments of the invention which are shown in the accompanying drawings with like reference numerals indicating corresponding parts throughout, wherein.

DESCRIPTION OF THE PREFERRED EMBODIMENTS

Figure 1:
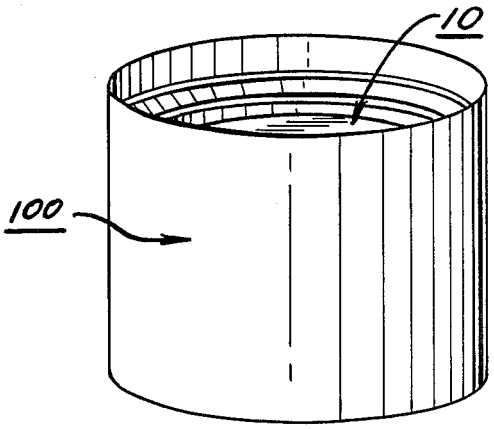
FIG. 1 is a front perspective view of a liquid storage tank having a pontoon roof or cover floating on the liquid contained therein and utilizes the sealing system of the invention.

Referring now to FIG. 1, there is illustrated a cross-sectional view of a liquid storage tank 100 having a floating cover or pontoon roof 10 which is movable relative to the inner walls 11 of the tank. The roof 10 is sealed against the inner wall 11 of the tank to prevent external contaminants such as rain, snow, ice, dust, dirt, or the like from entering into the contents contained within the tank, and to prevent escape of any vapors generated by the product contained therewithin.

Figure 2:
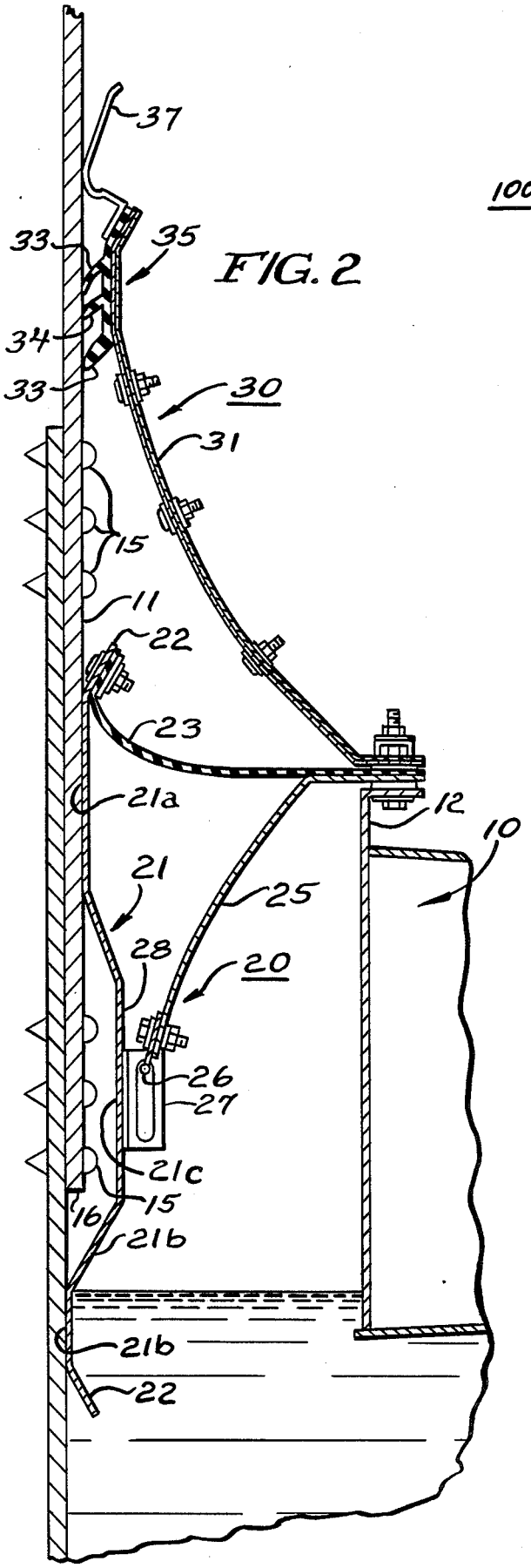
FIG. 2 is an enlarged cross-sectional view of a portion of the tank, floating roof and sealing system of the invention to better illustrate the features thereof.

As better illustrated in more detail in FIG. 2, the floating cover or pontoon 10 floats upon the liquid or product contained within the tank 100 in a manner known to those skilled in the art. In order to preserve the integrity of the liquid contained in the liquid storage tank 100, and to prevent product vapors from escaping, a suitable sealing system is utilized, generally referred to as a primary 20 and secondary 30 sealing system, respectively. These sealing systems 20 and 30 must accommodate upward and downward movement of the floating roof in response to variations in the quantity of liquid contained within the tank, and eccentricities in the substantially circular cross-section of the storage tank itself while maintaining sealing integrity even during wind loading.

In the sealing system of the present invention, the primary seal 20 comprises a stepped metallic shoe 21 supported from a raised rim 12 of the floating pontoon 10 and positioned to engage the inner wall 11 of the tank shell to provide a sealing function and to provide a centering force on the floating pontoon 10 to counter wind loading forces applied against the roof when in use.

The metallic shoe 21 is stepped and has a two-portion outer circumferential face which engages the inner wall 11 of the tank shell forming two contact faces or bands **21*a* and 21*b* between the show and the inner tank wall. The upper and lower tip portions 22 of the shoe 21 are bent inwardly toward the pontoon 10, and function to guide the shoe faces 21*a* and 21*b* over irregularities in the inner tank surface, especially horzontally disposed rivet heads 15 used in fastening steel sections during tank fabrication and forming steps 16 occuring where riveted sections of the tank are joined. A central section 21*c* of the shoe 21 is spaced inwardly, out of contact with the inner wall 11 of the tank shell 10**, to facilitate movement of the shoe over these internal irregularities and to prevent the liquid contained within the storage tank from risng upwardly between the inner wall of the tank shell and the metallic shoe due to capillary action between the shoe and the inner wall of the tank shell.

A vapor impermeable fabric annulus 23 is fastened between the upper tip end of the metallic shoe 21 and the flange 12 of the pontoon roof 10 to provide a vapor-impermeable barrier between the liquid contained within the storage tank and the atmosphere. A nylon fiber-center sandwich, between layers of white chlorosulfonated polyethylene, such as available from Reeves Brothers, Vulcan Division, Buena Vista, Va. and sold under the trademark "HYPALAN"has been found to be suitable for this purpose.

In order to provide a sufficient force to bias the shoe 21 into engagement with the inner wall 11 of the tank shell, and to provide a center force against wind loading, a circumferential spring shield 25 is provided between the metal shoe 21 and the floating pontoon 10. One end of each of the plates forming the spring shield 25 is secured to the rim flange 12 of the floating pontoon, and the other or free end thereof has connected thereto a pin 26 which engages a slotted bracket 27 secured to the inner face 28 of the central section **21*c* of the shoe. The size of the circumferentially extending plates forming the spring shield 25 is such that a biasing force is exerted outwardly against the shoe 21 at all times to maintain sealing integrity, while the spring shield applies a centering force to the floating pontoon. During wind loading lateral movement of the floating pontoon on the surface of the liquid is accommodated through the pin and slider connection without causing any relative movement between the metallic shoe 21 and the inner wall 11** of the tank shell.

Referring now to the upper portion of FIG. 2, there is shown the secondary sealing system 30 comprising a plurality of metallic weather shield sections 31 such as disclosed in the inventor's prior patent, U.S. Pat. No. 4,273,250, the disclosure of which is herein incorporated by reference. These sections 31 also assist in providng a centering force on the floating pontoon 10 to compensate for wind loading forces. A seal 35, having a substantially "E"-shaped cross-section is secured to the upper free end of the weather shield sections 31 while the lower end of the weather shield section is secured to the rim flange 12 of the floating pontoon. Individual stand-off bars 37 are secured to the end of the weather shield sections 31 and are positioned at spaced intervals circumferentially about the inner wall of the tank shell to assist in guiding the spring shields sections 31 as the pontoon 10 floats up or down on the contents contained within the tank shell. As the spring shield sections 31 encounter irregularities, especially such as the vertically disposed lines of rivet heads 15, or steps 16 formed in tank shell construction, the "E"-shaped secondary seal 35, carried at the upper free end of the spring shield sections 31, forms an annulus extending about the interior of the tank shell and functions in the manner previously described with reference to the inventor's U.S. Pat. No. 4,273,250. This "E"-shaped seal 35 may be formed from an extrusion of a Buna-Nitral material, and is formed to include a pair of upper and lower flanges 33 which appear in cross section as fingers extending outwardly from the base portion. The flanges 33 extend a sufficient distance to contact and form a seal with the inner wall 11 of the tank shell, and are biased into sealing contact with the shell by the action of the spring shield 31. Positioned between the upper and lower flanges 33 is an outwardly extending shorter flange 34 which extends outwardly from the base portion of the seal a distance sufficient to be adjacent to the outermost extension of the rivet heads 15 utilized to join sections of the tank shell. The shorter flange 34 functions as a stiffener or brace to prevent the adjacent sealing flanges 33 from bending down into contact with each other, or too far so that they might lose their sealing function. In this manner, the shorter flange 34 will function as a stiffener or brace to brace the sealing flange as it moves over the rivet head 15 or the step 16 to maintain the sealing function.

Figure 3:
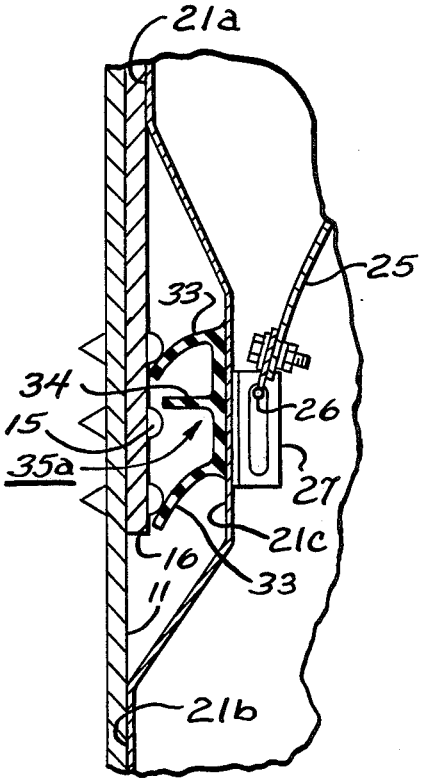
FIG. 3 is an enlarged portion of the cross-sectional view of FIG. 2 to better illustrate a modification of the sealing system shown therein to illustrate another embodiment thereof for better accommodating a vapor seal and points of irregularities within the tank shell.

As shown in FIG. 3, in an alternative embodiment, a second "E"-shaped seal **35*a* may be utilized on the face of the central portion 21*c* of the metallic shoe 21 to perform the same function as the secondary seal 35 previously described. In this manner, the seal 35*a* will further ensure that vapors from the liquid contained within the storage tank do not escape between the outer face of the metallic shoe 21 and the inner wall 11** of the tank shell.

While the invention has been described in the specification and illustrated in the drawings with reference to a preferred embodiment, it will be understood by those skilled in the art that various changes may be made and equivalents may be substitued for elements thereof without departing from the scope of the invention. In addition, many modifications may be made to adapt a particular situation or material to the teachings of the invention without departing from the essential scope thereof. Therefore, it is intended that the invention not be limited to the particular embodiment illustrated by the drawings and described in the specifications as the best mode presently contemplated for carrying out this invention, but that the invention will include any embodiments falling within the description of the appended claims.

What is claimed is:

1. A sealing system for use with a liquid storage tank having a roof freely floating on the contents stored within the tank comprising a circumferentially radially outwardly extending primary sealing means for engaging a radially inwardly directed inner wall of the liquid storage tank to form a seal therewith, said primary sealing means including sealing shoe means resiliently biased into contact with the inner wall of the liquid storage tank for forming a seal thereagainst, said sealing shoe means comprising two vertically spaced sealing sections spaced apart by a stepped portion to facilitate vertical movement of said sealing shoe means relative to the inner wall of the storage tank, a circumferentially radially outwardly extending secondary sealing means for engaging a radially inwardly directed inner wall of the liquid storage tank to form a seal therewith, said secondary sealing means comprising at least two sealing flanges of a first length positioned one on each side of a sealing flange of a second length less than said first length, each of said sealing flanges extending outwardly from a common base towards engagement with the tank walls for forming a seal thereagainst, and primary sealing means supporting means and second sealing means supporting means, each of said supporting means adapted to be connected to the roof of the liquid storage tank for supporting said primary sealing and said secondary sealing means and applying a force thereto biasing said primary sealing means and said secondary sealing means into sealing engagement with the inner wall of the liquid storage tank forming said seal thereagainst.

2. The sealing system of claim 1 wherein said sealing flanges of said secondary sealing means extend normal to the inner walls of the liquid storage tank when in an unbiased condition and when biased into sealing contact wipe said wall upon movement of the tank roof relative thereto.

3. The sealing system of claim 1 wherein said primary sealing means includes a vapor-impermeable material secured at one end to the floating roof and at the other end to said sealing shoe means for forming an annulus of vapor barrier material to seal the space between the roof and the inner wall of the storage tank.

4. The sealing system of claim 1 wherein said primary sealing means supporting means comprises a resilient support having an inner end adapted to be carried by the floating roof and positionable to extend radially outwardly therefrom toward the inner wall of the storage tank for applying a biasing force to said sealing shoe means and a free end engaging said stepped portion of said sealing shoe means.

5. The sealing system of claim 4 wherein said stepped portion of said sealing shoe means includes a slotted bracket for engaging the free end of said resilient support to facilitate vertical movement of said primary sealing means relative to the inner wall of the storage tank.

6. The sealing system of claim 1 wherein the ends of said sealing shoe means are turned inwardly to facilitate vertical movement of said primary sealing means relative to the inner wall of the storage tank.

7. A sealing system for sealing the space between a liquid storage tank shell and the tank roof freely floating on the liquid stored within the tank shell, the sealing system comprising a plurality of vapor-impermeable shield sections for engaging a radially inwardly directed inner wall of a liquid storage tank to form a substantially liquid tight seal therewith, said plurality of vapor-impermeable shield sections being positionable to extend radially outwardly from the perimeter of the roof of the liquid storage tank toward the radially inwardly directed inner wall thereof, flexible sealing means carried on an outer end of said plurality of vapor-impermeable shield sections for engaging the radially inwardly directed inner wall of the liquid storage tank to form a substantially liquid and vapor tight seal therewith, said flexible sealing means comprising a plurality of horizontally extending annual sealing flanges extending outwardly from said vapor-impermeable shield sections, said plurality of annular flanges including a pluarality of annular flanges of a first length with an annular flange of a second length, less than said first length, positioned therebetween such that upon contact thereof with the inner wall of a liquid storage tank said annular flanges will be flexed into contact with said annular flange of a second length to form a support to brace said annular flanges of said greater length against said inner wall of the liquid storage tank, shoe sealing means for engaging a radially inwardly directed inner wall of the liquid storage tank to form a seal therewith, said shoe sealing means being carried by the floating roof of the liquid storage tank and having a sealing face engaging the inner wall of the liquid storage tank for forming a seal therewith, said sealing face comprising at least two vertically spaced sealing sections spaced apart by a spaced portion inwardly stepped to facilitate movement of said sealing shoe means along the inner wall of the storage tank, and vapor barrier means carried by and extending between the floating roof of the liquid storage tank and the shoe sealing means for forming a seal therebetween.

8. The sealing system of claim 7 further including stand-off bar means carried by a free end of said shield section for guiding the vertical movement thereof relative to the tank inner wall.

* * * * *